US008939880B2

(12) United States Patent
Yamaya

(10) Patent No.: US 8,939,880 B2
(45) Date of Patent: Jan. 27, 2015

(54) SHEET FOLDING MECHANISM

(75) Inventor: Yu Yamaya, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 531 days.

(21) Appl. No.: 13/365,788

(22) Filed: Feb. 3, 2012

(65) Prior Publication Data

US 2012/0208689 A1 Aug. 16, 2012

(30) Foreign Application Priority Data

Feb. 15, 2011 (JP) ..... 2011-030284

(51) Int. Cl.
*B31F 1/10* (2006.01)
*B65H 45/14* (2006.01)

(52) U.S. Cl.
CPC ..... *B65H 45/144* (2013.01); *B65H 45/148* (2013.01)
USPC ..... 493/444; 493/420

(58) Field of Classification Search
CPC .. B65H 45/148; B65H 45/144; B65H 45/142; B65H 45/147; B65H 45/12; B31F 1/10
USPC ..... 493/444, 419, 420, 421
See application file for complete search history.

(56) References Cited

U.S. PATENT DOCUMENTS 5,118,379 A * 6/1992 Martin et al. ..... 156/442.1
7,503,886 B2 * 3/2009 Sekine et al. ..... 493/434
7,726,648 B2 * 6/2010 Tamura et al. ..... 271/176
8,641,590 B2 * 2/2014 Smith et al. ..... 493/421
8,740,212 B2 * 6/2014 Yasuda et al. ..... 270/45
8,771,159 B2 * 7/2014 Imazu et al. ..... 493/320
8,777,824 B2 * 7/2014 Kimata ..... 493/23
2011/0058876 A1 * 3/2011 Yasuda et al. ..... 399/407
2012/0165175 A1 * 6/2012 Hayashi ..... 493/465

FOREIGN PATENT DOCUMENTS

JP 2004-284719 A 10/2004
JP 4842708 B2 12/2007

OTHER PUBLICATIONS

English language abstract for patent publication No. JP-2007-320665 which corresponds to JP-4842708-B2.

* cited by examiner

*Primary Examiner* — Hemant M Desai
(74) *Attorney, Agent, or Firm* — Harness, Dickey & Pierce, P.L.C.

(57) ABSTRACT

A sheet folding mechanism includes a sheet conveying path that is curved in a sheet conveyance direction; a pair of folding rollers that are disposed at a downstream side of the sheet conveying path; an abutting stopper member that is disposed at the downstream side of the folding rollers in the sheet conveyance direction and that abuts and restricts a leading edge of a conveyed sheet; a flexure assist member that assists flexure forming of the sheet abutted to the abutting stopper member; a curved conveying guide plate that is located at the sheet conveying path; a movable stopper guide plate that is a part of the curved conveying guide plate as being movable along the sheet conveying path; and a control unit that performs control to vary a movement range of the movable stopper guide plate in accordance with size and folding mode of the sheet.

10 Claims, 16 Drawing Sheets

SHEET FOLDING MECHANISM

CROSS-REFERENCE TO RELATED APPLICATIONS

The present application claims priority to and incorporates by reference the entire contents of Japanese Patent Application No. 2011-030284 filed in Japan on Feb. 15, 2011.

BACKGROUND OF THE INVENTION

1. Field of the Invention

The present invention relates to a sheet post-processing apparatus for an image forming apparatus, and specifically, relates to a sheet folding mechanism to perform a folding process which is utilized as one of functions of a sheet folding apparatus, a sheet folding apparatus using the same, and an image forming apparatus.

2. Description of the Related Art

A folding process is one of functions of a sheet post-processing apparatus. There has been known a technology of performing a folding process to bend a conveyed sheet by utilizing a sheet leading edge stopper, a flexure assist member and a folding roller and to wind the bent part to the folding roller.

To prevent occurrence of poor folding even when a curled sheet is conveyed, Japanese Patent Application Laid-open No. 2004-284719 discloses a structure including a first roller portion and a second roller portion which perform a folding process and a sheet guide member which is protruded toward the second folding roller portion at predetermined timing. Here, the sheet guide portion pushes an end part of a sheet-folded section formed by the first folding roller portion into a sheet nip portion during a folding process by the second folding roller portion.

A linear shape is popularly employed for a conveying path (i.e., a stopper conveying path) to a sheet leading edge stopper which constitutes a conventional sheet folding process. To satisfy market needs of product thinning, it is required that a stopper conveying path is formed to have a curved shape for performing a sheet folding process in a conserved space. In a case that the stopper conveying path is formed as being curved, in a mode of a two-time folding process for a sheet (e.g., inner threefold), the sheet once folded is conveyed to the stopper conveying path at the time of second folding. Then, the sheet forms a curvature when the sheet is abutted to the sheet leading edge stopper and is conveyed to the nip portion of folding rollers. The sheet is to be conveyed while the sheet edge at the upper side is abutted to a guide plate having the first fold line as a boundary during sheet conveyance. Then, there arises a problem of occurrence of box-folding, that is, another fold line is to be formed at a position being deviated from the first fold line when the second folding is performed as a result of occurrence of speed difference between an upper sheet and a lower sheet caused by the conveying load.

Therefore, there is a need for a mechanism to prevent occurrence of box-folding to have another fold line at a position being deviated from the first fold line when the second folding is performed.

SUMMARY OF THE INVENTION

It is an object of the present invention to at least partially solve the problems in the conventional technology.

According to an embodiment, there is provided a sheet folding mechanism that includes: a sheet conveying path that is curved in a sheet conveyance direction; a pair of folding rollers that are disposed at a downstream side of the sheet conveying path in the sheet conveyance direction; an abutting stopper member that is disposed at the downstream side of the pair of folding rollers in the sheet conveyance direction and that abuts and restricts a leading edge of a conveyed sheet; a flexure assist member that assists flexure forming of the sheet abutted to the abutting stopper member; a curved conveying guide plate that is located at the sheet conveying path; a movable stopper guide plate that is a part of the curved conveying guide plate as being movable along the sheet conveying path by a driving unit; and a control unit that performs control to vary a movement range of the movable stopper guide plate in accordance with a size of the sheet to be conveyed and a folding mode of the sheet.

According to another embodiment, there is provided a sheet folding apparatus that includes the sheet folding mechanism according to the above embodiment.

According to still another embodiment, there is provided an image forming apparatus that includes the sheet folding apparatus according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
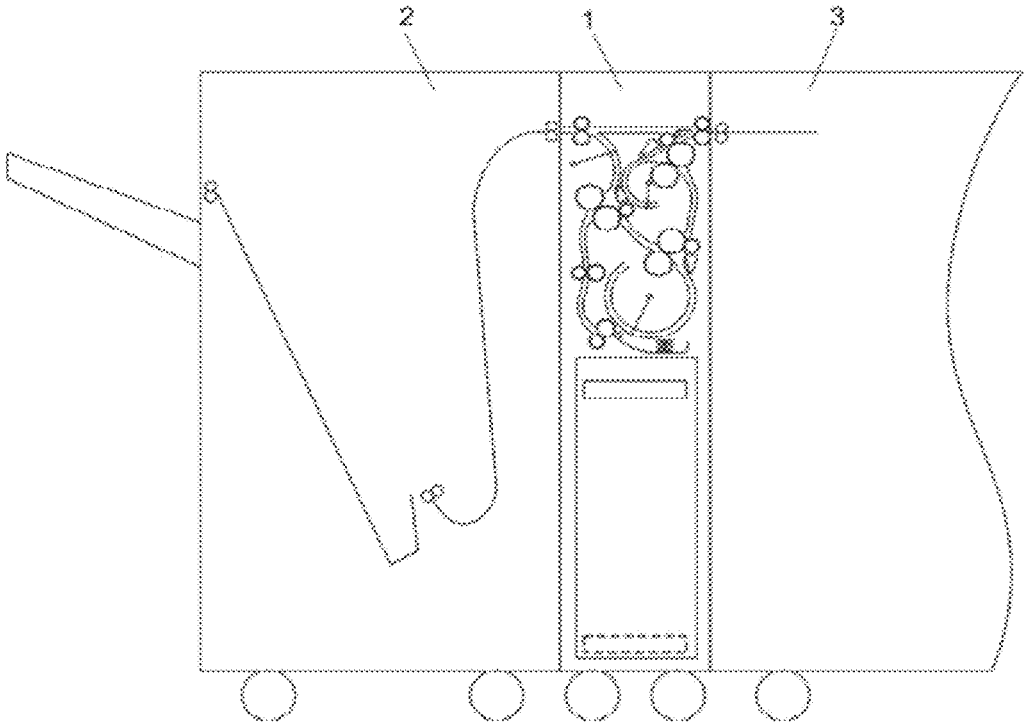
FIG. 1 is an overall layout view illustrating arrangement in which a sheet folding apparatus, a sheet post-processing apparatus, and an image forming apparatus according to the present invention are combined.

In embodiments of the present invention, a guide plate at a curved stopper conveying path is moved along the conveying path at predetermined timing after a sheet is abutted to a leading edge stopper, so that sheet speed difference due to conveying load between the sheet and the guide plate is eliminated. To eliminate the sheet speed difference at the curved stopper conveying path, the guide plate at the stopper conveying path having a curved shape is moved in a direction along the conveying path. Accordingly, it becomes possible to perform a sheet folding process without causing box-folding owing to reduced conveying load against the sheet guide plate. Further, it can be expected to have effects of preventing image smudges and playing a function of a sheet guide member as well.

In the embodiments of the present invention, it is possible to prevent poor folding such as box-folding by moving the guide plate in the sheet conveyance direction to reduce speed difference between the outer side and the inner side of the folded sheet toward folding rollers. Further, the movable stopper guide plate and the flexure assist member are activated as being mutually synchronized. In conventional mechanisms, when the flexure assist member is activated, a sheet in the stopper conveying path is conveyed toward a nip portion of the folding rollers; and at that time, there occurs speed difference owing to contact load of the sheet pulled to the folding rollers with the guide plate. However, the above can be avoided by activating the movable stopper guide plate in synchronization with the flexure assist member, so that the sheet speed difference can be reduced.

Further, the end part of the movable stopper guide plate at the folding roller side guides a sheet to the sheet leading edge stopper in a state of being located at the folding roller side against the end part of a guide plate at the upstream side and at the outer side of the conveying path. It becomes possible to avoid conveyance problems caused by curling and the like during sheet conveyance to the sheet leading edge stopper.

When the movable stopper guide plate and the flexure assist member are arranged so that the movable stopper guide plate is moved to the folding rollers of the sheet folding mechanism and the flexure assist member is retracted at that time, the sheet speed difference can be further eliminated and box-folding can be prevented by playing a roll of sheet edge suppressing which is performed by the flexure assist member and moving to the nip portion of the folding rollers.

When the movable stopper guide plate is formed to have a shape to be capable of being moved to the folding rollers of the sheet folding mechanism without having interference with the flexure assist member, it is possible to further simplify driving control owing to that the flexure assist member is not required to be retracted.

Further, when a plurality of the movable stopper guide plates are disposed in the sheet conveyance direction and each movable stopper guide plate is independently driven in a designated movable range, the sheet folding process can be performed at higher conveyance speed. Accordingly, productivity of the sheet folding process can be improved.

Further, when the movable stopper guide plate is formed of a flexible member, the movable stopper guide plate can be driven along the conveying path even in a case that curvature of moving stopper guide plate is difference from curvature of the curved conveying path in the movable range. Here, the movable stopper guide plate can be returned to have the original curvature when returned to a home position.

Further, when a surface shape of the movable stopper guide plate includes a rib shape, sheet conveying load is reduced owing to reduced contact area between the curved conveying guide plate and the sheet.

First Embodiment

A first embodiment of the present invention will be described with reference to the drawings.

Figure 2:
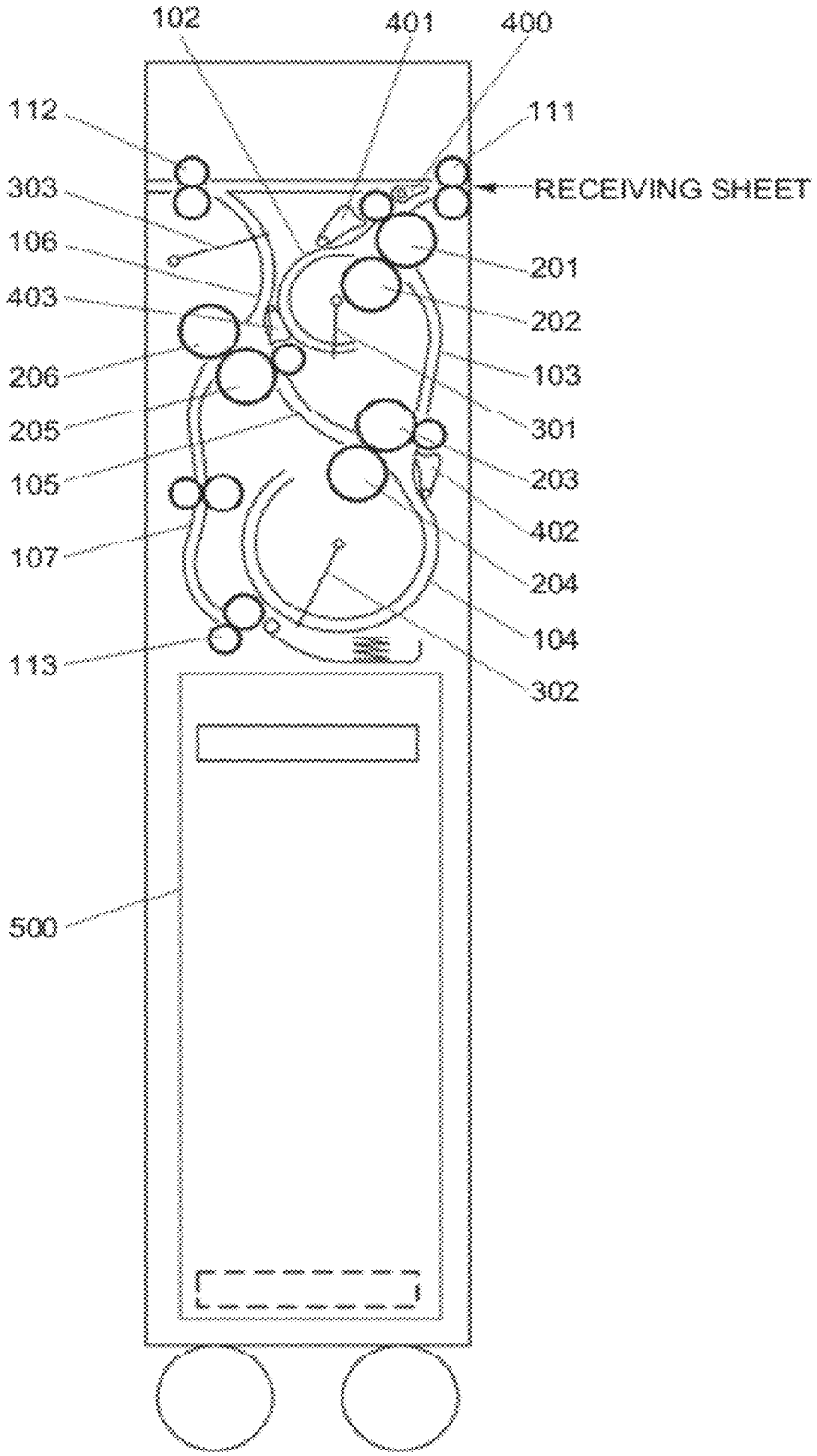
FIG. 2 is an internal layout view of the sheet folding apparatus.

FIG. 1 is an overall layout view illustrating arrangement in which a sheet folding apparatus 1, a sheet post-processing apparatus 2, and an image forming apparatus 3 according to the present invention are combined. FIG. 2 is an internal layout view of the sheet folding apparatus 1. Here, targets of the present invention include an image forming apparatus of a type in which the sheet folding apparatus 1 and the image forming apparatus 3 are integrated and an image forming apparatus in which the sheet post-processing apparatus 2 is further integrated. The present invention is not limited to a type in which each apparatus is independent as the illustrated example. In the present specification, in addition to denoting a single apparatus which performs image forming such as a copying machine, there is a case that an image forming apparatus denotes an image forming apparatus being so-called system equipment in which peripheral apparatuses such as a sheet folding apparatus and a sheet post-processing apparatus are combined with such a single image forming apparatus.

The sheet folding apparatus 1 receives a sheet discharged from the image forming apparatus 3 being an antecedent apparatus at an inlet carriage roller 111 and performs folding. The folded sheet is discharged to a stocker unit 500 by a stocker discharging carriage roller 113 or is discharged to the sheet post-processing apparatus 2 being a subsequent apparatus by a discharging carriage roller 112.

A structure of the present embodiment will be further described with reference to FIGS. 3A and 3B, and FIG. 4. Specifically, description is performed on poor folding caused by a problem occurring at a curved stopper path with FIGS. 3A and 3B and on advantages of the embodiment of the present invention with FIG. 4.

Figure 3A:
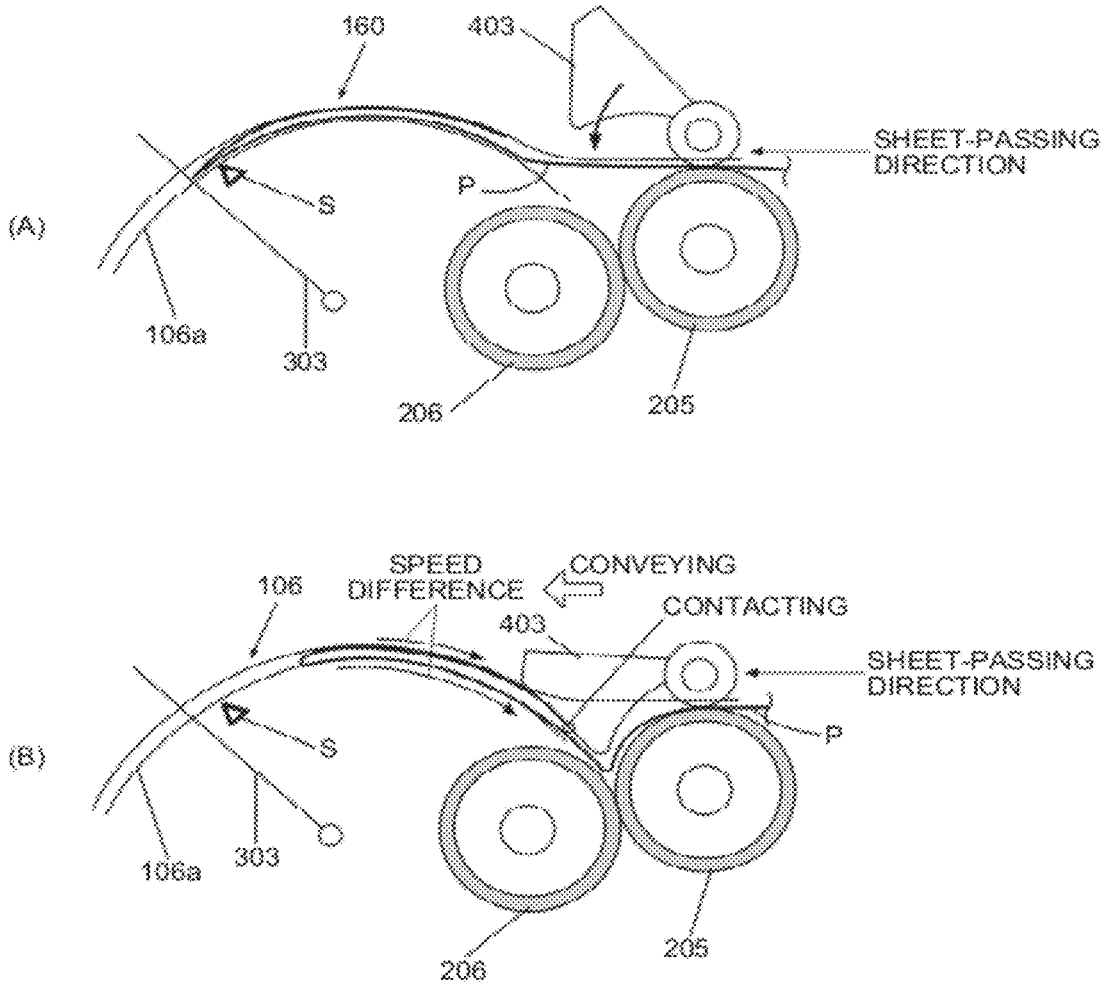
FIG. 3A illustrates cross-section of a mechanism according to the present invention, viewed so that the conveyance direction of a sheet conveyed from the upstream side to a pair of folding rollers of FIG. 2 is set horizontally.
Figure 4:
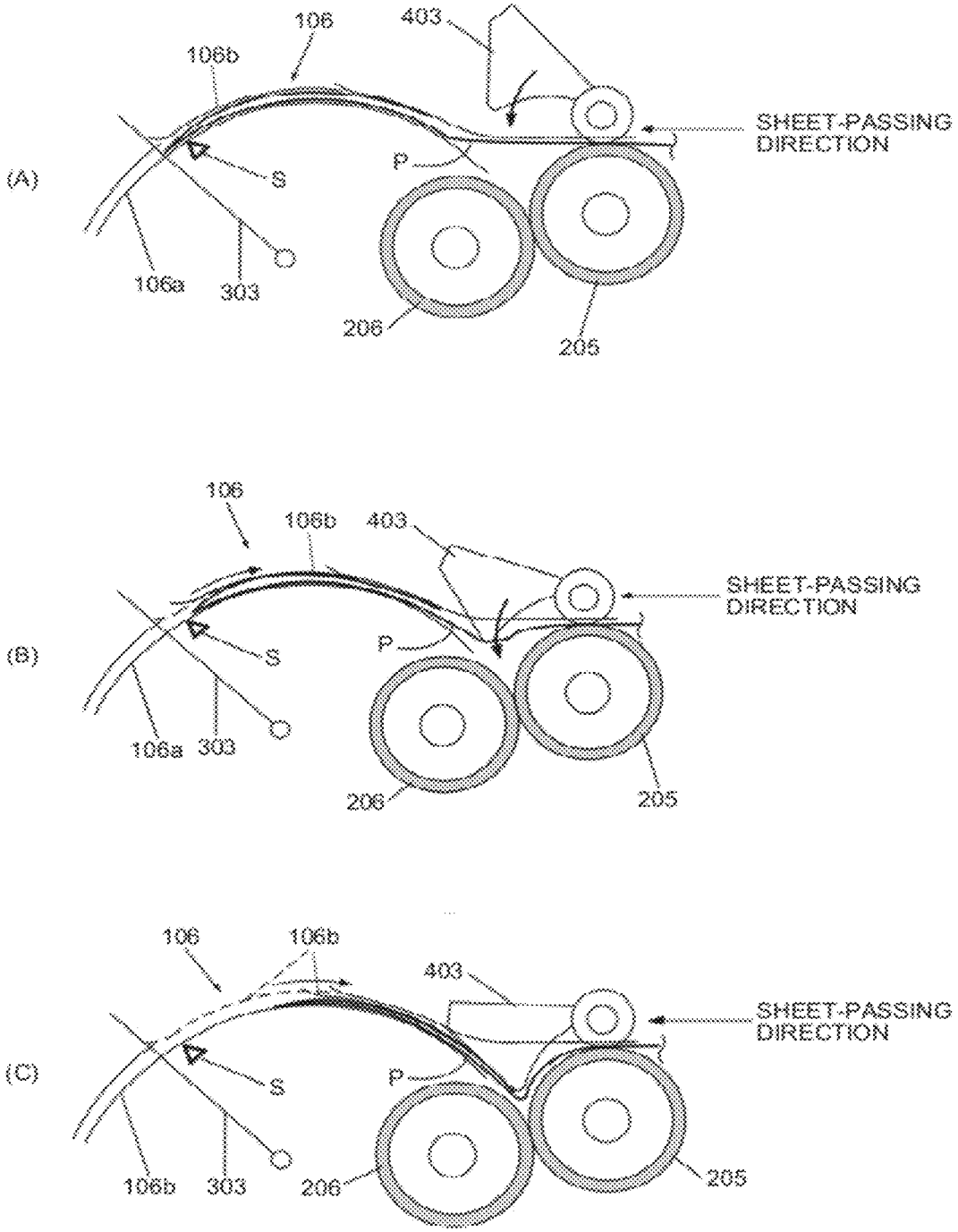
FIG. 4 illustrates cross-section of the mechanism, viewed so that the conveyance direction of the sheet conveyed from the upstream side to the pair of folding rollers of FIG. 2 is set horizontally.

FIG. 3A and FIG. 4 are sectional views of portions corresponding to a fifth folding roller 205 and a sixth folding roller 206 illustrated in FIG. 2 (with slight structural difference) illustrating as setting a conveyance direction of a sheet conveyed from the upstream side toward the folding rollers 205 and 206 to be horizontal. Further, the drawings illustrate views at the time of the second folding process of an inner threefold mode. Here, in the above and following drawings and description thereof, the same numerals as in FIG. 2 are used for illustration and the same numerals and names are used for description. However, it should be noted that there is slight structural difference therebetween.

As described in a later-mentioned embodiment, in the inner threefold mode, sheet folding is not performed at a first folding roller 201 and a second folding roller 202 as being passed by. The first folding process is performed at a third folding roller 203 and a fourth folding roller 204.

As illustrated in (A) of FIG. 3A, a sheet P is conveyed from the upstream side to the folding rollers 205 and 206, and then, is abutted to a third stopper 303 (hereinafter, called a sheet leading edge stopper 303) through a third stopper conveying path 106 (hereinafter, a stopper conveying path 106). At that time, a flexure assist member 403 is activated after the sheet P is detected by a sheet leading edge detecting sensor S which is disposed at the stopper conveying path 106.

Figure 3B:
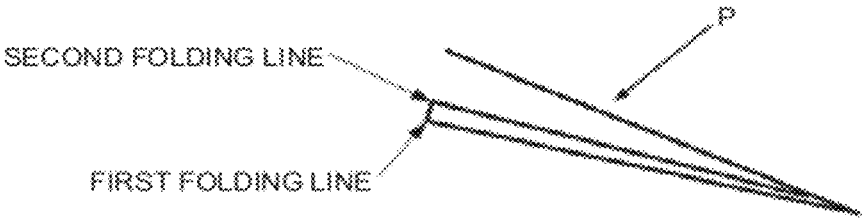
FIG. 3B illustrates a box-folding.

As illustrated in FIG. 3B, when a part of the sheet P conveyed into the stopper conveying path 106 is conveyed to a nip portion of the folding rollers 205 and 206, a sheet edge at the outer side cannot be prevented from flapping (i.e., fluttering or waiving) by the nature of being paper as the sheet P at the outer side is conveyed into the curved stopper conveying path 106. Since conveying is to be performed while the sheet edge is continuously contacted to a guide plate 106*a* which structures the stopper conveying path 106, conveying load is to be generated. The conveying load causes speed difference such that the sheet at the upper side is continuously delayed against the sheet P at the lower side.

As a result, as illustrated in FIG. 3B, a fold line is to be formed in the folding process at a position being deviated from a fold line formed in the first folding process. Thus, poor folding being so-called "box-folding" occurs.

A solution in the first embodiment of the present invention against the abovementioned problem will be described with reference to FIG. 4.

In FIG. 4, (A) illustrates a similar state to (A) of FIG. 3A. As illustrated in (B) of FIG. 4, the flexure assist member 403 is activated after the leading edge of the sheet P is detected by the sheet leading edge detecting sensor S. At the same time, a movable stopper guide plate 106*b* is activated as well and is rotated in the same direction as the conveyance direction of the sheet P. Accordingly, the movable stopper guide plate 106*b* is moved to a predetermined position illustrated in (C) of FIG. 4. In this state being different from the state of (B) of FIG. 3A, since the movable stopper guide plate 106*b* at the outer side of the stopper conveying path 106 is moved in accordance with conveying of the sheet P, the load of the sheet edge at the outer side or the sheet surface is reduced against the movable stopper guide plate 106*b*. Accordingly, it becomes possible to eliminate speed difference between the outer side and the inner side of the sheet P, so that a phenomenon of the abovementioned box-folding can be prevented from occurring.

Figure 5:
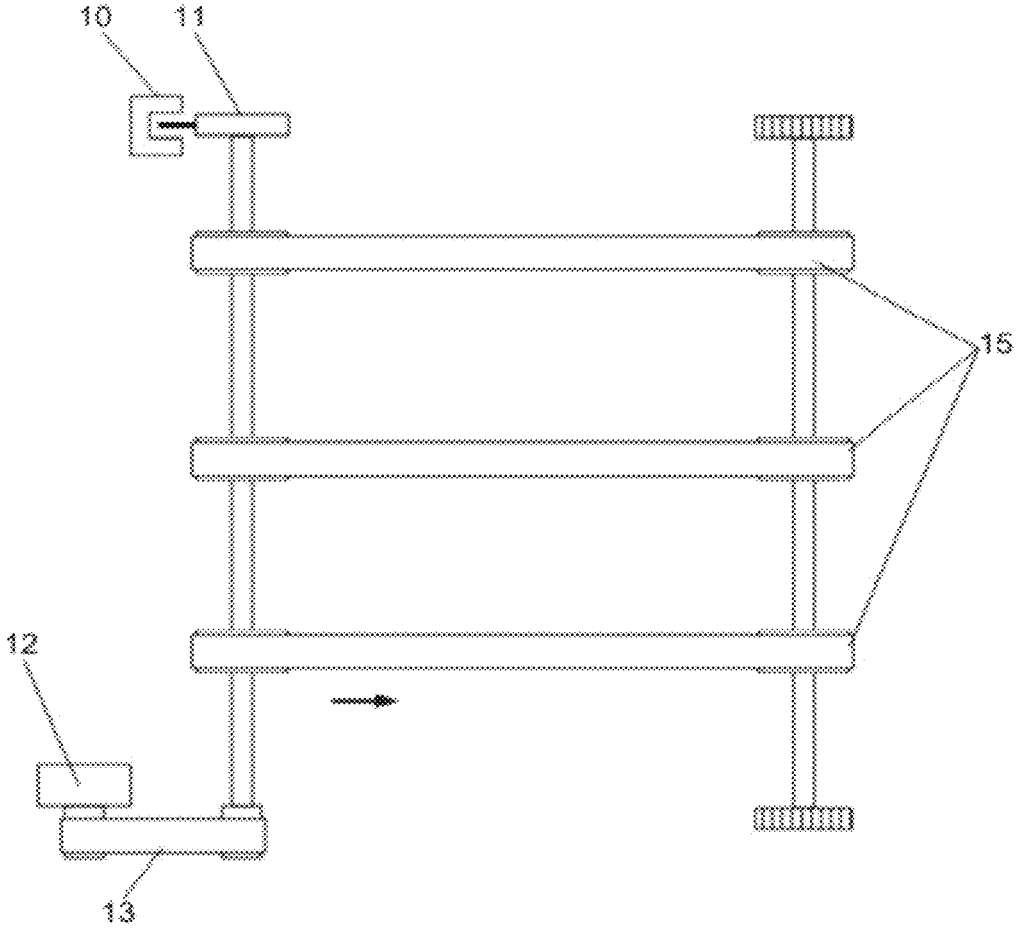
FIG. 5 is a view illustrating a peripheral driving structure of a movable stopper guide plate.

Next, a driving method of the movable stopper guide plate 106*b* at the curved stopper conveying path will be described. Specifically, a peripheral driving structure of the movable stopper guide plate 106*b* is illustrated in FIG. 5 and a structure of drive transmitting to the movable stopper guide plate 106*b* is illustrated in FIG. 6.

A home position of the movable stopper guide plate 106*b* is determined by a stepping motor 12, a belt 13, a feeler 11, and an optical sensor 10, so that control of displacement motion and the like can be performed. Further, an end of the movable stopper guide plate 106*b* is connected to a belt 15 as illustrated in FIG. 6 and a rail 17 is disposed respectively to both ends of the movable stopper guide plate 106*b* in a direction parallel to the sheet conveyance direction. Thus, specifically-controlled driving of the movable stopper guide plate 106*b* can be performed. Further, in the movable stopper guide plate 106*b*, it is preferable that a surface shape at a side to convey the sheet P is to be a shape having less contacting surface area with the sheet P (e.g., a rib shape, but not limited) targeting to reduce frictional resistance. Further, it is preferable that the movable stopper guide plate 106*b* is made of Mylar (registered trademark) material, for example, enabling to be movable along the conveying path which has different curvature therefrom and to maintain curvature intrinsic to the stopper guide plate when being at a position to guide the sheet P to the sheet leading edge stopper 303.

Figure 7:
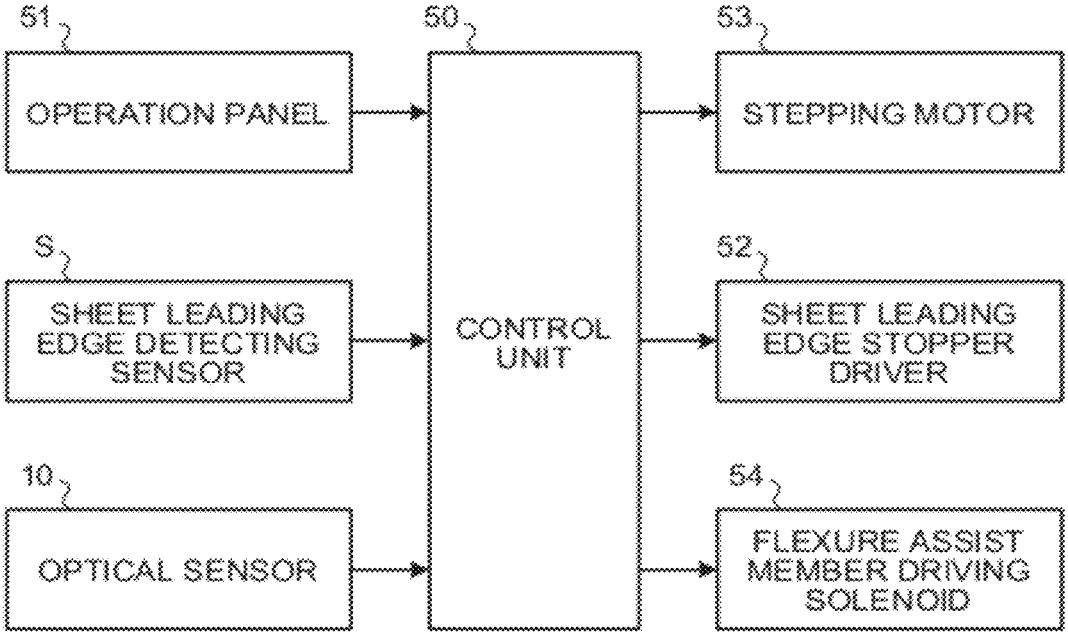
FIG. 7 is a view illustrating a cooperative system of a control unit and respective portions being control targets for the control unit according to an embodiment of the present invention.

FIG. 7 illustrates a cooperative system of a control unit 50 and respective portions being control targets for the control unit of the embodiment of the present invention.

Figure 6:
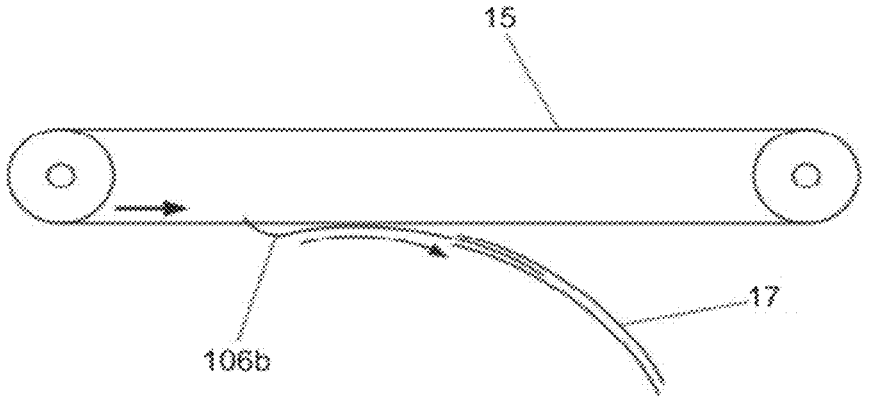
FIG. 6 is a view illustrating a structure of drive transmitting to the movable stopper guide plate.

An input side of the control unit 50 is connected with an operation panel 51 capable of inputting a sheet size and a folding mode, the sheet leading edge detecting sensor S utilized for setting operational timing of the sheet leading edge stopper 303, and the optical sensor 10 illustrated in FIG. 6. An output side thereof is connected with a driver 52 of the sheet leading edge stopper utilizing a solenoid and the like, a stepping motor 53 (corresponding to the stepping motor in FIG. 5) being a driving source of the movable stopper guide plate 106*b*, and a driving solenoid 54 of the flexure assist member 403. The control unit 50 determines conveyance speed of the sheet P with conveyance distance of the sheet P from a reference and performs selection of activation timing of the sheet leading edge stopper 303 and moving speed and operation timing of the movable stopper guide plate 106*b*.

Figure 8:
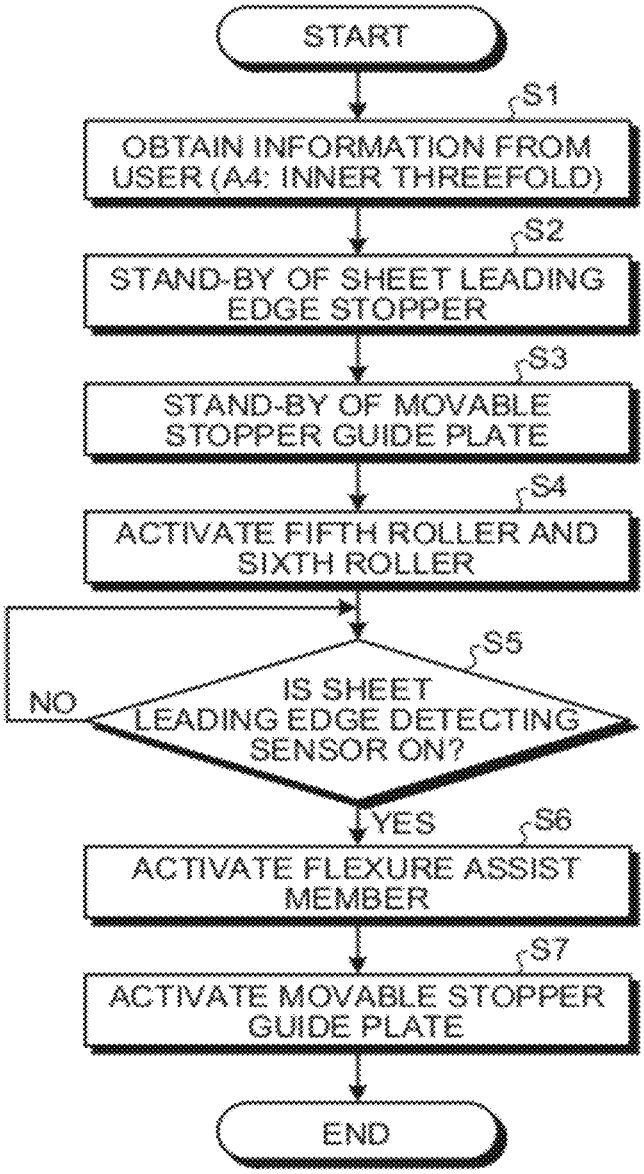
FIG. 8 is a view illustrating a series of control flow of a third folding section of A4 sheet inner threefold.

FIG. 8 illustrates a series of control flow of the third folding section for A4 sheet inner threefold. In the following, the reference character beginning with "S" in brackets denotes a step in the drawing.

Information of a sheet size and a folding mode is obtained from a user (S1). The sheet leading edge stopper stands by at a position corresponding to set folding length based on the obtained information (S2). The movable stopper guide plate 106*b* performs initializing operation and stands by at a position for guiding to the sheet leading edge stopper (S3). The fifth folding roller 205 and the sixth folding roller 206 are activated and a sheet is conveyed from the upstream side to the fifth folding roller 205 (S4). The sheet passes through the third stopper conveying path 106 and the sheet leading edge sensor detects the sheet (S5). After the sheet leading edge sensor performs the detection, the flexure assist member 403 is activated (S6). After the flexure assist member is activated, the movable stopper guide plate 106*b* is simultaneously activated at the time when the sheet is conveyed (S7). Driving thereof is performed while eliminating speed difference between the upper side and the lower side of the sheet toward the folding roller in the sheet conveyance direction, and then, a fold line is formed at the sheet by the fifth folding roller 205 and the sixth folding roller 206.

Second Embodiment

Figure 9A:
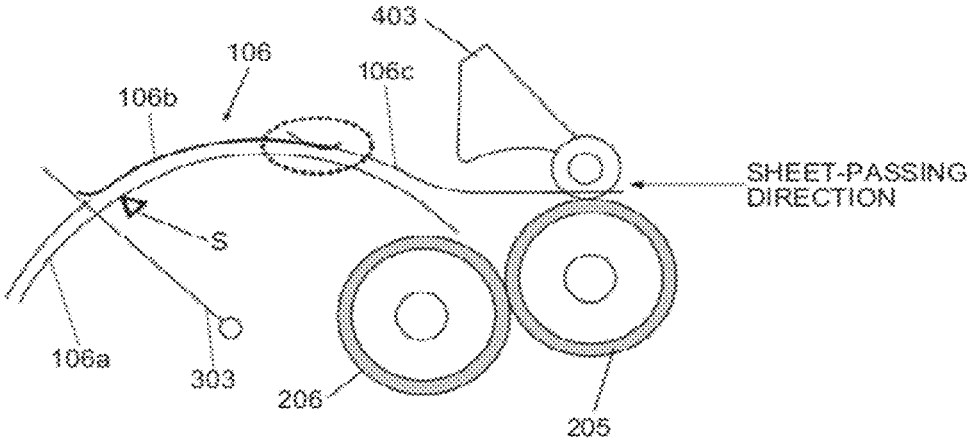
FIGS. 9A and 9B are views illustrating a guide structure of a second embodiment of the present invention.
Figure 9B:
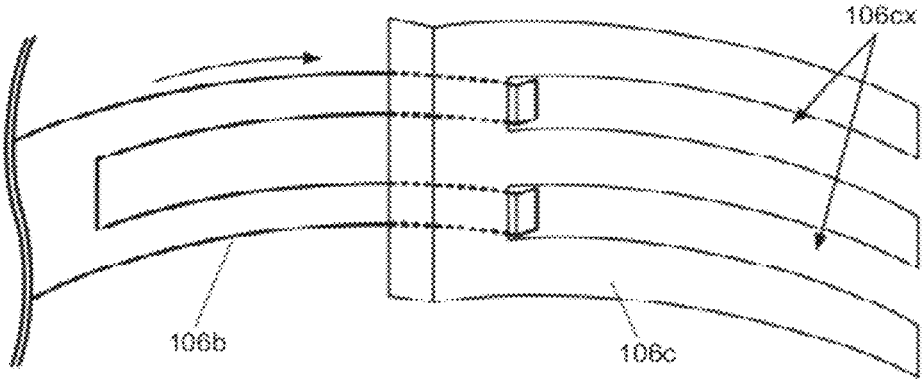

FIGS. 9A and 9B illustrate a second embodiment, and specifically, illustrates an example having a different structure to guide a sheet to the sheet leading edge stopper 303 by the movable stopper guide plate 106*b*. In the embodiment, as illustrated in FIG. 9B, an end part, at the side of folding rollers 205 and 206, of a guide plate (at the upper side) 106*c* at the upstream side of the movable stopper guide plate 106*b* is located to the outer side of the movable stopper guide plate 106*b* in a structure of the conveying path. The guide plate (at the upper side) 106*c* includes a plurality of groove-shaped portions 106*cx* which receive an end part of the movable stopper guide plate 106*b*. With this structure, when the sheet P is conveyed from the illustrated sheet-passing direction to the sheet leading edge stopper 303, it is possible to avoid conveyance problems such as stranding and jamming against the movable stopper guide plate 106*b* even when the conveyance leading edge part of the sheet P is curled. Here, in the second embodiment, an end part of the movable guide plate 106*b* at the side of the folding rollers 205 and 206 is changed in shape as illustrated. However, the shape of the end part is not necessarily changed. The end part of the movable stopper guide plate 106*b* at the side of the folding rollers 205 and 206 is simply required to be located outside the conveying path against the guide plate 106*c* at the upstream side. Thus, the structure of FIGS. 9A and 9B is just to be an example.

Figure 10:
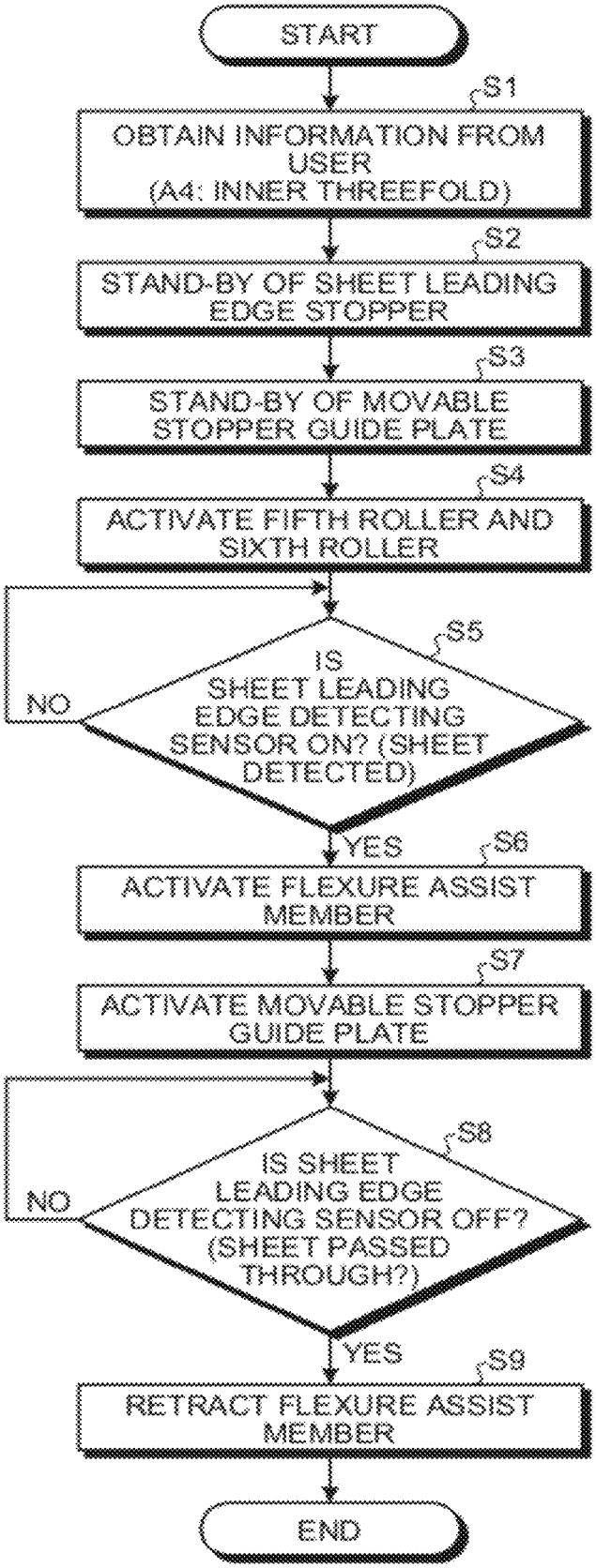
FIG. 10 is a view illustrating control flow of the second embodiment.

FIG. 10 illustrates control flow of the second embodiment. When information of a sheet size and a folding mode is obtained from a user (S1), the sheet leading edge stopper 303 stands by at a position corresponding to set folding length based on the obtained information (S2). Then, the movable stopper guide plate 106*b* performs initializing operation and stands by at a position for guiding the sheet P to the sheet leading edge stopper 303 (S3). The fifth folding roller 205 and the sixth folding roller 206 are activated and the sheet P is conveyed from the upstream side to the fifth folding roller 205 (S4). When the sheet P passes through the third stopper conveying path 106 and the sheet leading edge sensor S detects the sheet P (S5), the flexure assist member 403 is activated (S6). Then, the movable stopper guide plate 106*b* is activated and is moved toward the folding rollers 205 and 206 in the sheet conveyance direction (S7). Having that the sheet leading edge detecting sensor S becomes no detection as a trigger (S8), the flexure assist member 403 is rotated and retracted from the conveying path (S9). Then, the movable stopper guide plate 106*b* guides the sheet P to the nip portion of the fifth folding roller 205 and the sixth folding roller 206 and a fold line is formed at the sheet by the fifth folding roller 205 and the sixth folding roller 206.

Third Embodiment

Figure 11:
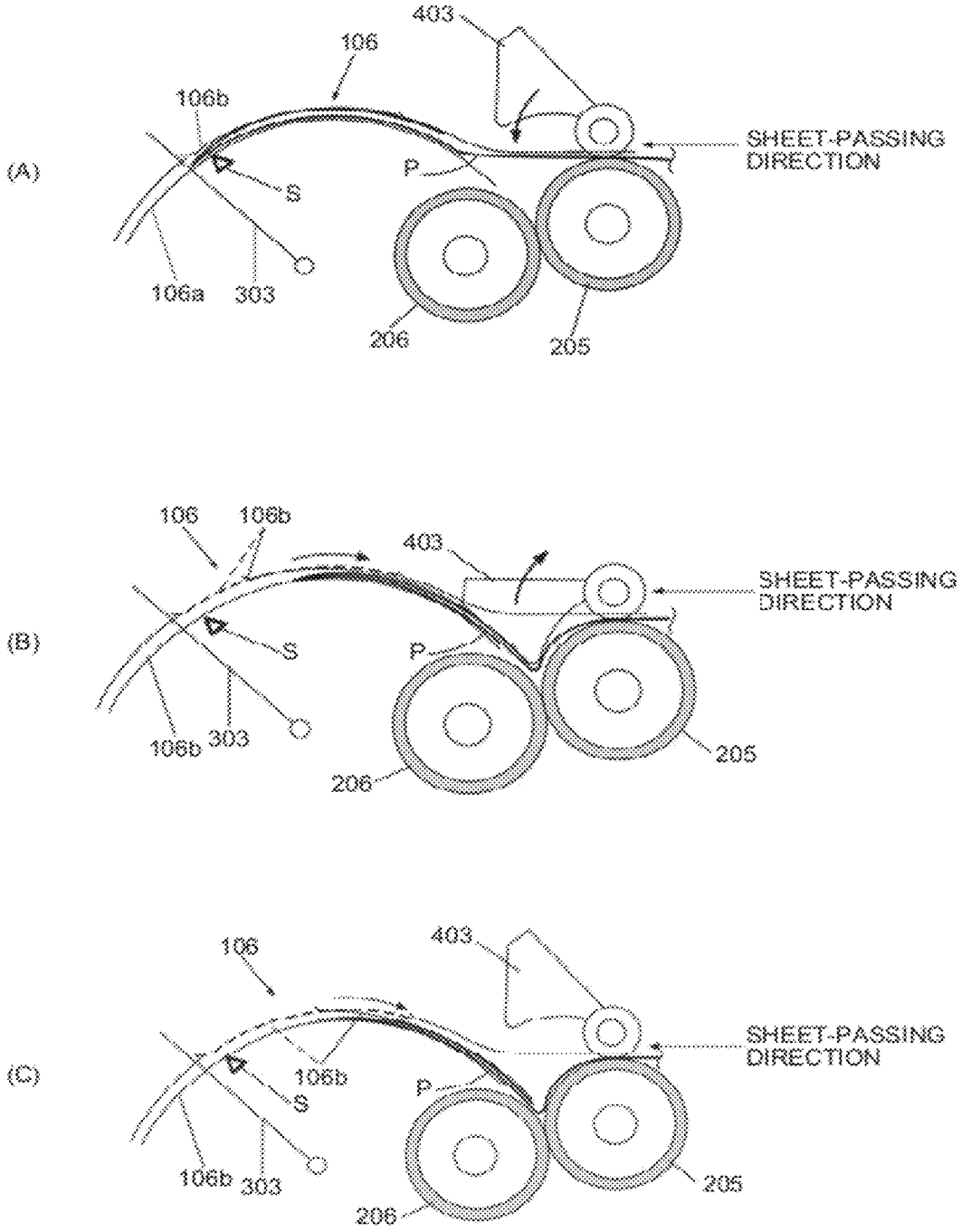
FIG. 11 illustrates a guide structure of a third embodiment of the present invention.

FIG. 11 illustrates a third embodiment, and specifically, illustrates another structural example of a movable stopper guide plate. In the example of FIG. 4, the flexure assist member 403 suppresses flapping of the sheet edge at the upper side by being folded. Here, since the flexure assist member 403 continues to keep its attitude after being activated, it becomes a factor of conveyance load at the sheet upper side, similarly to the conventional curved conveying guide plate. Accordingly, in the flowchart of FIG. 8, although speed difference of the sheet is eliminated in the curved conveying path, speed difference due to conveyance load against the flexure assist member 403 cannot be perfectly eliminated. Therefore, in the third embodiment, a flapping suppressing function of a sheet edge played by the sheet flexure assist is added in addition to the abovementioned eliminating function of sheet speed difference.

In FIG. 11, (A) illustrates a state that the movable stopper guide plate 106*b* is activated after sheet leading edge detection is performed and the sheet P in the stopper conveying path is guided thereby. In (B) of FIG. 11, the movable stopper guide plate 106*b* is moved in the sheet conveyance direction beyond the position for speed difference elimination (see (B) of FIG. 4). A state that the sheet flexure assist member 403 is to be retracted from the conveying path is illustrated having its start timing at the time when the sheet leading edge detecting sensor S detects passing of the leading edge of the sheet P. Further, (C) of FIG. 11 indicates that the sheet speed difference can be eliminated up to right before the nip portion of the folding rollers 205 and 206 as suppressing the flapping of the upper sheet edge.

Fourth Embodiment

Figure 12:
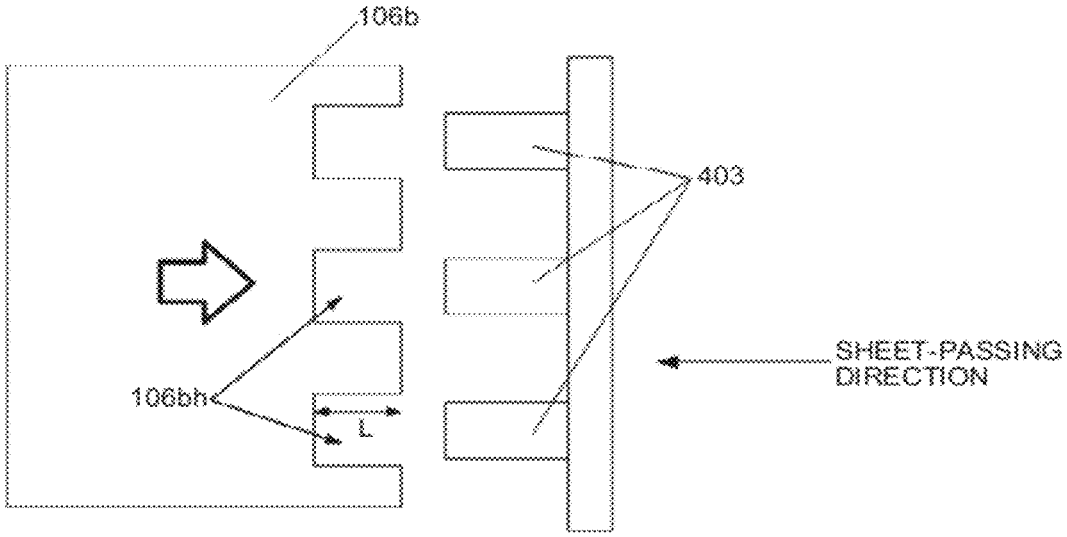
FIG. 12 is a view illustrating a state that a flexure assist member is not retracted in each embodiment.

FIG. 12 illustrates a state that the flexure assist member 403 is not retracted in each embodiment described above. Specifically, a shape of the movable stopper guide plate 106*b* not causing interference with the flexure assist member 403 when being moved to the nip portion of the folding rollers 205 and 206 is described as viewing the sectional views of FIG. 4 and FIG. 9A from the upper side.

As illustrated in FIG. 12, the end of the movable stopper guide plate 106*b* being close to the folding rollers 205 and 206 is formed like "a comb" as illustrated, for example, to avoid collision with the flexure assist member 403 which are formed in plural. Length L of recesses 106*bh* in the drawing is required to be length to the extent not to cause abutting with the flexure assist member 403 at the time when the movable stopper guide plate 106*b* is moved to the nip portion of the folding rollers 205 and 206.

Fifth Embodiment

Figure 13:
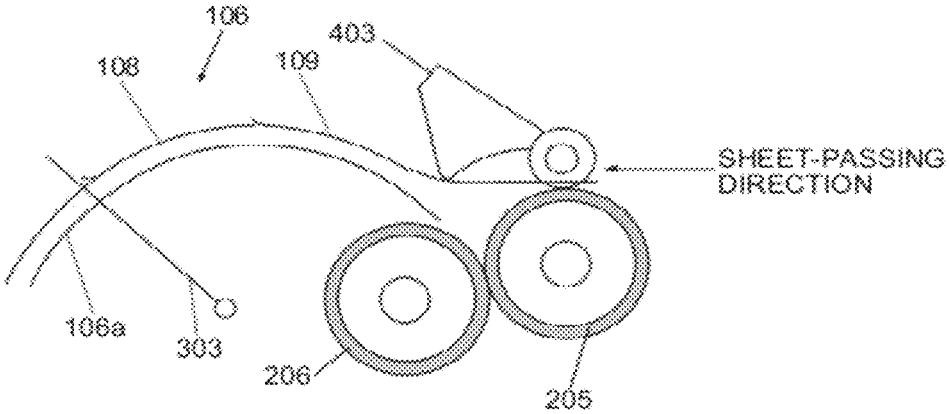
FIG. 13 is a view illustrating a structure of a sheet folding mechanism of a fifth embodiment of the present invention.
Figure 14:
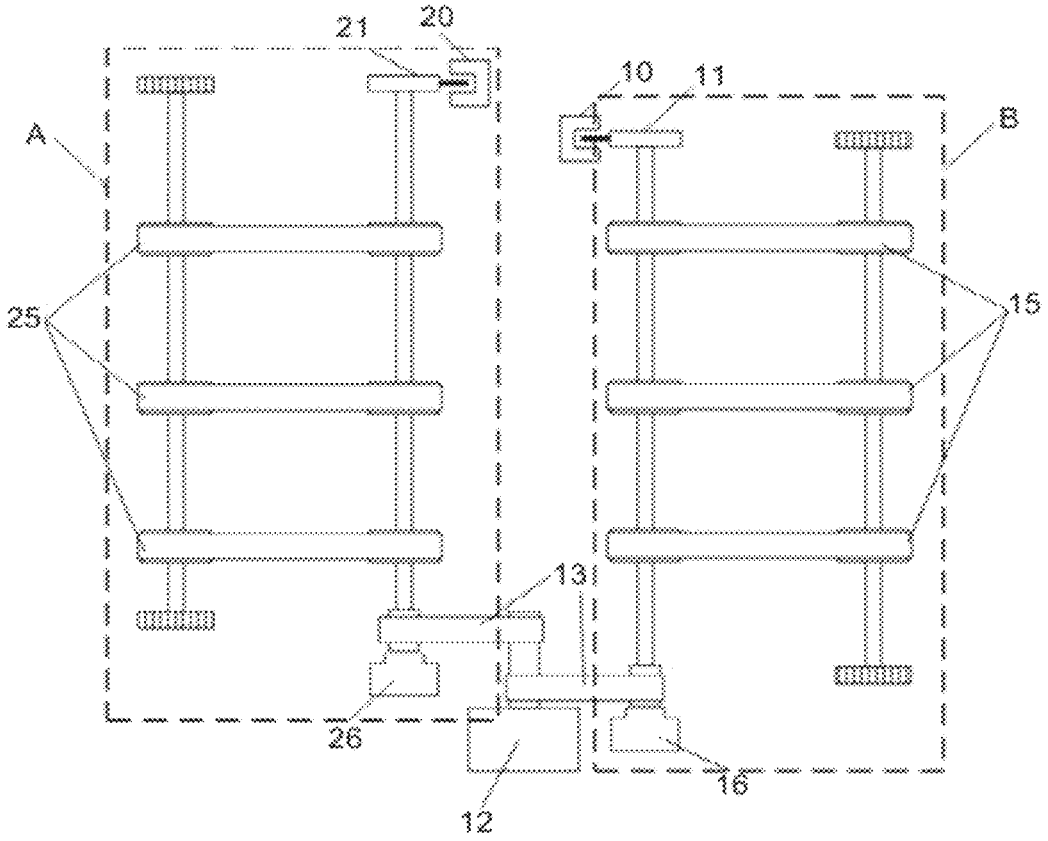
FIG. 14 is a view illustrating an example of a driving structure of the sheet folding mechanism of the fifth embodiment of the present invention.

FIGS. 13 and 14 illustrate a fifth embodiment. Specifically, FIGS. 13 and 14 illustrate a structural example of the sheet folding mechanism in which the movable stopper guide plate 106*b* is separated into plural pieces (e.g., two pieces in this example) as being arranged separately in the sheet conveyance direction to be moved in a mutually independent manner. FIG. 14 illustrates an example of a driving structure thereof. In the present example, the movable stopper guide plate 106*b* illustrated in FIG. 4 is referred to as "a speed difference eliminating guide plate 108" and the movable stopper guide plate 106*b* playing a roll of flexure assisting described with FIG. 11 is referred to as "a flexure assist guide plate 109". However, the usage of different names is only for convenience sake. The former is moved to a midway of the stopper conveying path and the latter performs to eliminate speed difference of the sheet P from the midway of the stopper conveying path to have a structure of being movable to the nip portion of the folding rollers as illustrated in FIG. 11.

Here, description is performed on FIG. 14. For example, a driving structure of section A in FIG. 14 is for the speed difference elimination guide plate 108 and that of section B is for the flexure assist guide plate 109. In the structure, driving is transmitted respectively to section A and section B by the stepping motor 12, the belt 13, and electromagnetic clutches 16 and 26. Each position control for belts 15 and 25 connected to the guide plates 108 and 109 respectively is performed by feelers 11 and 21 and optical sensors 10 and 20 as transmitting driving of the stepping motor 12 with ON/OFF of the electromagnetic clutches. With the structure to drive independently for each function of the speed difference elimination and flexure assistance, the guide plates 108, 109 can be returned to the standby position quicker than the abovementioned embodiment with less movement amounts of the guide plates 108, 109. That is, since the sheet folding process can be performed with higher conveyance speed, productivity of the sheet folding process can be improved.

Figure 15:
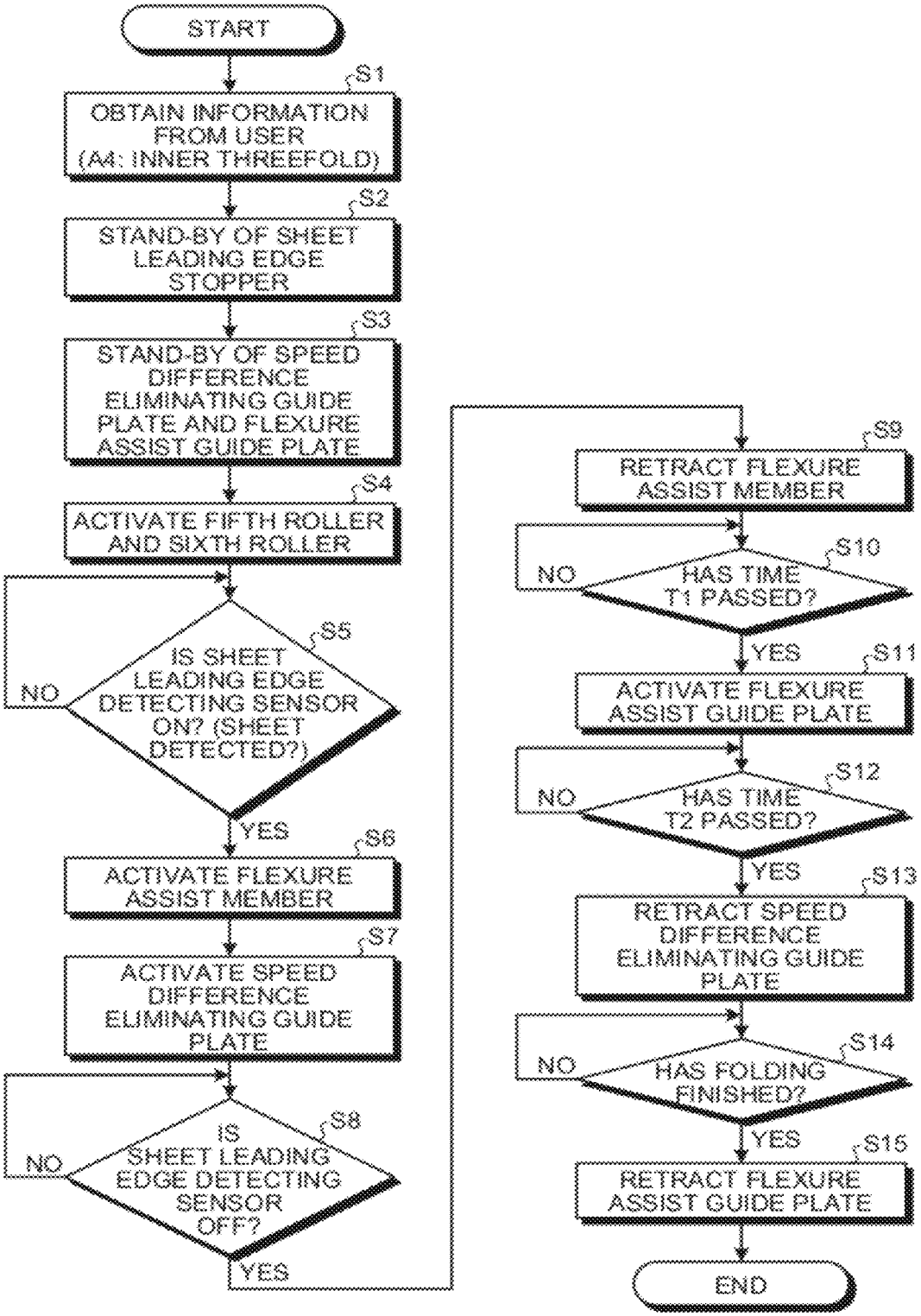
FIG. 15 is a view illustrating control flow of the driving structure of FIG. 14.

FIG. 15 illustrates control flow of the driving structure of FIG. 14. Information of a sheet size and a folding mode is obtained from a user (S1). The sheet leading edge stopper 303 stands by at a position corresponding to set folding length based on the obtained information (S2). Then, the speed difference eliminating guide plate 108 is bent and the electromagnetic clutches 16 and 26 respectively for the speed difference elimination guide plate 108 and the flexure assist guide plate 109 are activated and stand by at positions to guide the sheet P to the sheet leading edge stopper 303 after initializing operation is performed (S3). The fifth folding roller 205 and the sixth folding roller 206 are activated and the sheet P is conveyed from the upstream side to the fifth folding roller 205 (S4). The sheet P passes through the third stopper conveying path 106 and the sheet leading edge sensor S detects the sheet (S5). After the sheet leading edge sensor S performs the detection, the flexure assist member 403 is activated (S6). At that time, the speed difference eliminating guide plate 108 is activated as well and is driven toward the folding rollers 205 and 206 in the sheet conveyance direction (S7). Having that the sheet leading edge detecting sensor S becomes no detection as a trigger (S8), the flexure assist member 403 is retracted from the conveying path (S9). After the speed difference eliminating guide plate 108 is continuously driven for a certain time T1 to be at a position where the sheet P can be passed to the flexure assist guide plate 109 (S10), the flexure assist guide plate 109 is activated (S11). After a time T2 passes since the sheet passing to the flexure assist guide plate 109 is completed (Step S12), the speed difference eliminating guide plate 108 is retracted to the original standby position (S13). After it is determined that folding of the sheet P is completed (alternatively, after a time in which folding is determined to be completed) (S14), the flexure assist guide plate 109 is retracted from the fold conveying path and stands by as returning to a predetermined position to be ready for the next sheet (S15).

Description of a Variety of Folding Operations

Figure 16:
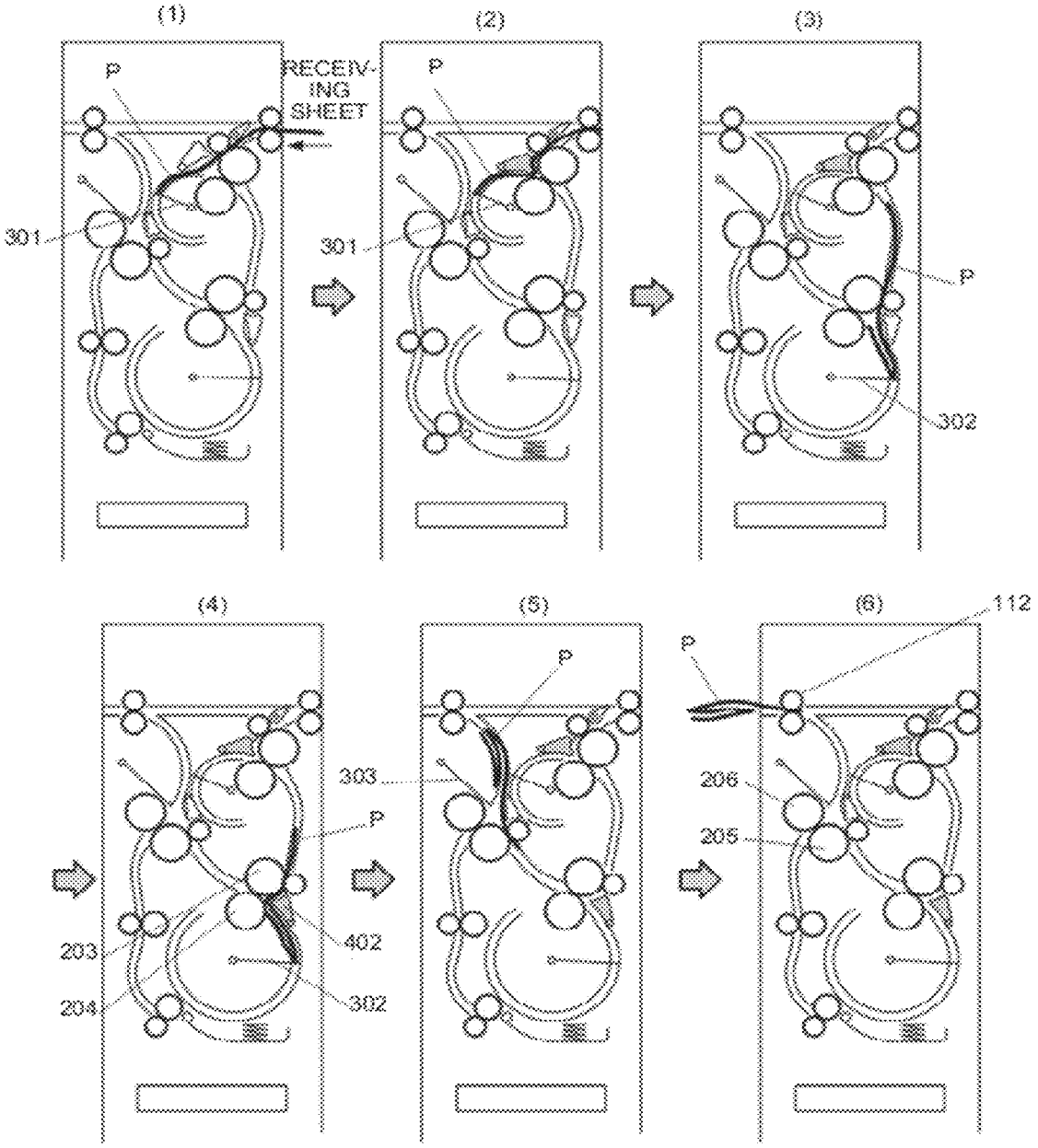
FIG. 16 illustrates operation of Z-shaped folding.
Figure 17:
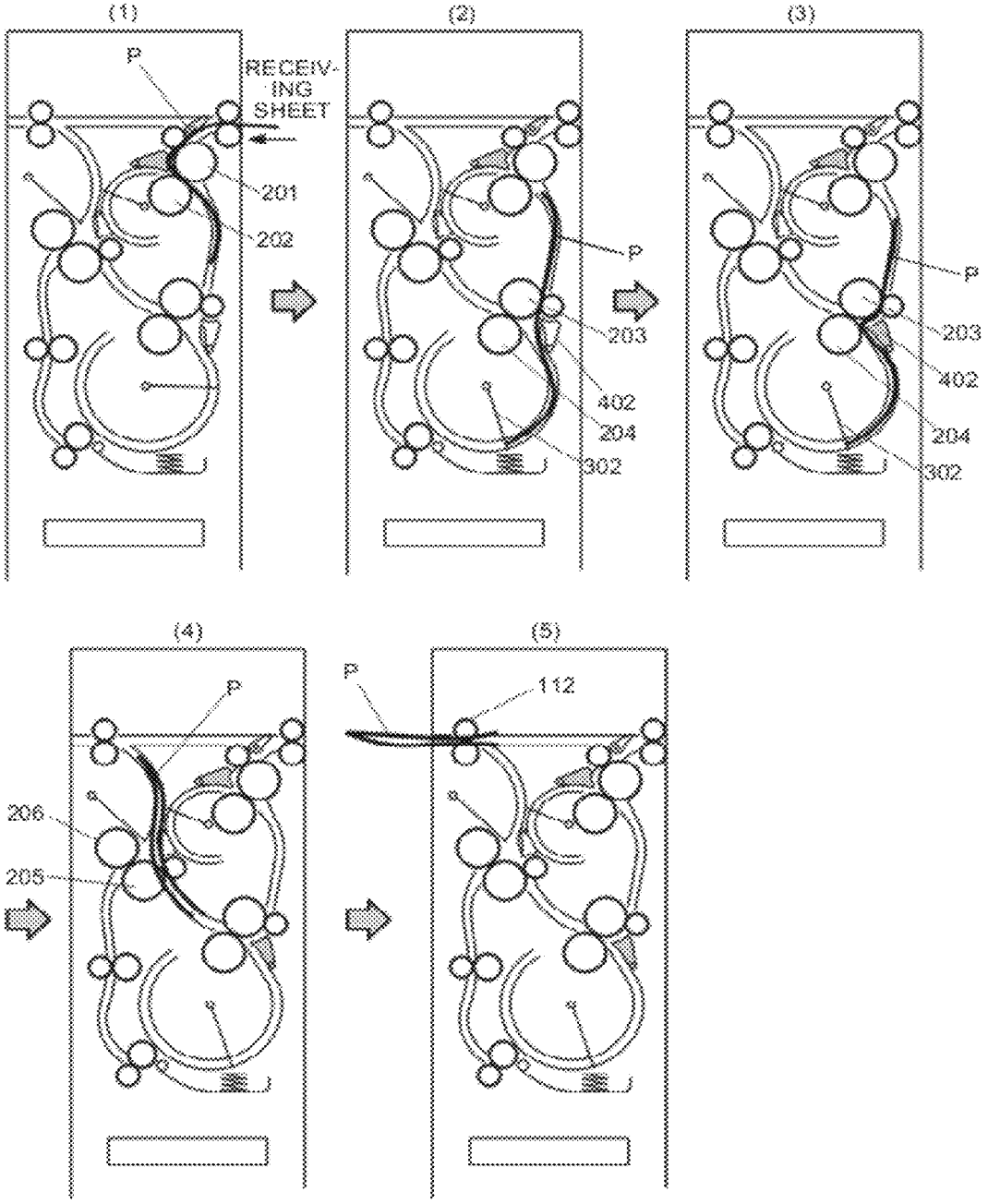
FIG. 17 illustrates operation of twofold.
Figure 18:
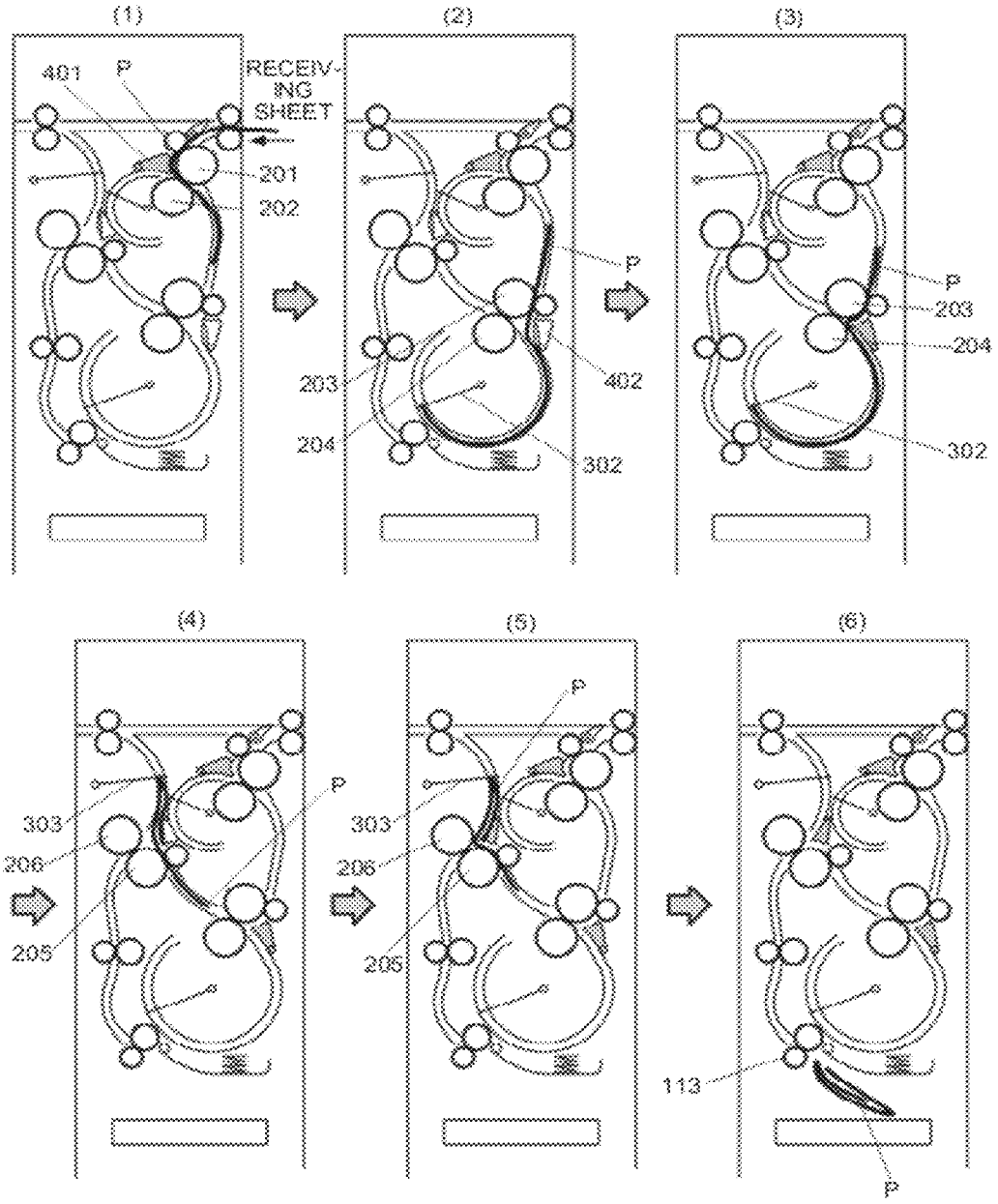
FIG. 18 illustrates operation of outer threefold and inner threefold.

Each folding operation will be described with reference to FIG. 2 which illustrates the structure of the apparatus to actualize the present invention. In the above embodiments, it is possible to perform folding operation of each of Z-shaped folding (FIG. 16), twofold (FIG. 17), outer threefold (FIG. 18), and inner threefold (FIG. 18).

Z-Shaped Folding

A sheet received from the image forming apparatus 3 is guided to a first stopper conveying path 102 by an inlet switching claw 400. The sheet is bent as the leading edge thereof is abutted to a first stopper 301 in the first stopper conveying path 102, and then, the first folding is performed at a first nip which is formed by the first folding roller 201 and the second folding roller 202. At the time of forming flexure of the first folding, the sheet is evenly bent to the folding roller side by operating a first flexure assist member 401. After the first folding is completed, the sheet is conveyed from a first intermediary conveying path 103 to a second stopper conveying path 104. The sheet is bent as the leading edge thereof is abutted to a second stopper 302 in the second stopper conveying path 104, and then, the second folding is performed at a second nip which is formed by the third folding roller 203 and the fourth folding roller 204. Thus, Z-shaped folding is to be completed at a second intermediary conveying path 105. At the time of forming flexure of the second folding as well, similarly to the first folding, a second flexure assist member 402 is operated. After folding is completed, the sheet passes through the third stopper conveying path 106 and is conveyed to a subsequent apparatus by the discharging carriage roller 112. Not being used in the Z-shaped folding mode, the third stopper 303 is at a position retracted from the third stopper conveying path 106.

Twofold

A sheet received from the image forming main body 3 is guided to the second stopper conveying path 104 through the first intermediary conveying path 103 as passing through the first nip which is formed by the first folding roller 201 and the second folding roller 202 without entering to the first stopper conveying path 102 by the inlet switching claw 400 and the first flexure assist member 401. The sheet is bent as the leading edge thereof is abutted to the second stopper 302 in the second stopper conveying path 104, and then, the first folding is performed at the second nip which is formed by the third folding roller 203 and the fourth folding roller 204. Thus, twofold is to be completed at the second intermediary conveying path 105. At the time of forming flexure of the first folding, the sheet is evenly bent to the folding roller side by operating the second flexure assist member 402. After the folding is completed, the sheet passes through the third stopper conveying path 106 and is conveyed to a subsequent apparatus by the discharging carriage roller 112. Not being used in the twofold mode, the third stopper 303 is at a position retracted from the third stopper conveying path 106.

Inner Threefold

A sheet received from the image forming main body 3 is guided to the second stopper conveying path 104 through the first intermediary conveying path 103 as passing through the first nip which is formed by the first folding roller 201 and the second folding roller 202 without entering to the first stopper conveying path 102 by the inlet switching claw 400 and the first flexure assist member 401. The sheet is bent as the leading edge thereof is abutted to the second stopper 302 in the second stopper conveying path 104, and then, the first folding is performed at the second nip which is formed by the third folding roller 203 and the fourth folding roller 204. Thus, the first folding is to be completed at the second intermediary conveying path 105. After the first folding is completed, the sheet is conveyed to the third stopper conveying path 106 and is bent as the leading edge thereof is abutted to the third stopper 303 in the third stopper conveying path 106. Then, the sheet is conveyed to the fifth folding roller 205 and the sixth folding roller 206 while speed difference of the folded sheet is eliminated as activating a (movable) curved conveying guide plate. The second folding is performed at the third nip which is formed by the fifth folding roller 205 and the sixth folding roller 206, so that inner threefold is completed at a stocker conveying path 107. After the folding is completed, the sheet is stored in the stocker unit 500 by the stocker discharging carriage roller 113.

Outer Threefold

A sheet received from the image forming main body 3 is guided to the second stopper conveying path 104 through the first intermediary conveying path 103 as passing through the first nip which is formed by the first folding roller 201 and the second folding roller 202 without entering to the first stopper conveying path 102 by the inlet switching claw 400 and the first flexure assist member 401. The sheet is bent as the leading edge thereof is abutted to the second stopper 302 in the second stopper conveying path 104, and then, the first folding is performed at the second nip which is formed by the third folding roller 203 and the fourth folding roller 204. Thus, the first folding is to be completed at the second intermediary conveying path 105. After the first folding is completed, the sheet is conveyed to the third stopper conveying path 106 and is bent as the leading edge thereof is abutted to the third stopper 303 in the third stopper conveying path 106. Then, the second folding is performed at the third nip which is formed by the fifth folding roller 205 and the sixth folding roller 206, so that outer threefold is completed at the stocker conveying path 107. After the folding is completed, the sheet is stored in a stocker unit 500 by a stocker discharging carriage roller 113.

According to the embodiments, it is possible to perform a sheet folding process without causing box-folding. Further, it can be expected to have effects of preventing image smudges and playing a function of a sheet guide member as well.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding mechanism, comprising:

a sheet conveying path that is curved in a sheet conveyance direction;

a pair of folding rollers that are disposed at a downstream side of the sheet conveying path in the sheet conveyance direction;

an abutting stopper member that is disposed at the downstream side of the pair of folding rollers in the sheet conveyance direction and that abuts and restricts a leading edge of a conveyed sheet;

a flexure assist member that assists flexure forming of the sheet abutted to the abutting stopper member;

a curved conveying guide plate that is located at the sheet conveying path;

a movable stopper guide plate that is a part of the curved conveying guide plate as being movable along the sheet conveying path by a driving unit; and a control unit that performs control to vary a movement range of the movable stopper guide plate in accordance with a size of the sheet to be conveyed and a folding mode of the sheet.

2. The sheet folding mechanism according to claim 1, wherein the movable stopper guide plate and the flexure assist member are activated as being mutually synchronized.

3. The sheet folding mechanism according to claim 1, wherein an end part of the movable stopper guide plate at a side of the folding rollers guides the sheet to the sheet leading edge stopper in a state of being located at the side of folding rollers against an end part of a guide plate at an upstream side in the sheet conveyance direction and outside the sheet conveying path.

4. The sheet folding mechanism according to claim 1, wherein the movable stopper guide plate and the flexure assist member are arranged so that the movable stopper guide plate is moved to be close to the folding rollers and the flexure assist member is retracted during the movement of the movable stopper guide plate so as not to disturb the movement thereof.

5. The sheet folding mechanism according to claim 1, wherein the movable stopper guide plate has a shape to be capable of being moved to the folding rollers without having interference with the flexure assist member.

6. The sheet folding mechanism according to claim 1, wherein a plurality of the movable stopper guide plates are disposed along the sheet conveyance direction, each movable stopper guide plate being capable of being driven to be moved independently in a predetermined range.

7. The sheet folding mechanism according to claim 1, wherein the movable stopper guide plate is formed of a flexible member.

8. The sheet folding mechanism according to claim 1, wherein the movable stopper guide plate has a rib shape on a surface thereof.

9. A sheet folding apparatus comprising the sheet folding mechanism according to claim 1.

10. An image forming apparatus comprising the sheet folding apparatus according to claim 9.

* * * * *